US006019021A

United States Patent [19]

Keyvani

[11] Patent Number: 6,019,021

[45] Date of Patent: Feb. 1, 2000

[54] FINGER ACTUATED HAND TOOL

[76] Inventor: Daryoush Keyvani, 321 S. San Vicente, Ste. 302, Los Angeles, Calif. 90048

[21] Appl. No.: 08/844,257

[22] Filed: Apr. 18, 1997

Related U.S. Application Data

[60] Provisional application No. 60/039,493, Feb. 28, 1997.

[51] Int. Cl.[7] ..... B25B 7/06

[52] U.S. Cl. ..... 81/416; 30/257; 294/104; 433/159

[58] Field of Search ..... 81/300, 416; 30/131, 30/257; 606/83, 174, 205; 433/159; 294/103.1, 104

[56] References Cited

U.S. PATENT DOCUMENTS

| | | | |
|---|---|---|---|
| 541,294 | 6/1895 | Smith . | |
| 1,093,726 | 4/1914 | Pearson . | |
| 1,845,798 | 2/1932 | Keiser, Jr. . | |
| 2,508,805 | 5/1950 | Scott . | |
| 3,156,980 | 11/1964 | Vosbikian | 30/253 |
| 5,157,996 | 10/1992 | Keyvani | 81/416 |
| 5,339,712 | 8/1994 | Keyvani . | |

FOREIGN PATENT DOCUMENTS

| | | |
|---|---|---|
| 704090 | 3/1941 | Germany . |

*Primary Examiner*—James G. Smith
*Attorney, Agent, or Firm*—Gene Scott - Patent Law & Venture Group

[57] ABSTRACT

A hand tool provides a slender elongated shape having a pair of finger actuation plates, one of which drives an interior rod. The end of the tool is adapted with a fixed jaw and a movable jaw attached to the interior rod. With the tool held in the manner of a pencil, the thumb and first finger are in position for moving the actuation plates so as to produce corresponding motion in the jaws. The tool allows the sensitive motion and tactile feedback inherent to the fingers to be transferred along the length of the tool for grasping, cutting and other useful actions.

11 Claims, 3 Drawing Sheets

FINGER ACTUATED HAND TOOL

This application is based upon a previously filed Provisional patent application, Ser. No. 60/039,493, filed on Feb. 28, 1997, having a title, "Finger-Held Pliers and Cutters," and filed by the same inventor, Daryoush Keyvani.

BACKGROUND OF THE INVENTION

1. Field of the Invention

This invention relates generally to hand tools such as gripping pliers, wire cutters and such, and more particularly to a pencil thin linear tool having a pair of finger controlled surfaces for manipulating a pair of jaws which may be turned inwardly toward the user for visibility.

2. Description of Related Art

The following art defines the present state of this field:

Smith, U.S. Pat. No. 541,294 describes a pair of shears. These shears are particularly adapted for cutting sheets of metal or other fairly hard material. In their use, they will enable a cut to be made completely across a large sheet of material without the severed portion in any way interfering with the easy forward movement of the shears while cutting.

Pearson, U.S. Pat. No. 1,093,726 describes scissors and shears that are comprised of an upper cutting blade, a lower handle, and an intermediate pivot-tube integral blade and handle.

Keiser, U.S. Pat. No. 1,845,798 describes shears that are especially adaptable for cutting grass and other growths or lawns and like places. This invention has a device whereby a person standing in an upright position may easily and quickly cut grass, which is close to curbing and other objects, and obviates the necessity of the person assuming a bent over or cramped position in order to operated the cutting blade. Operating members carry at their lower ends cutting blades movable relative to each other by the operation of handles secured to the upper ends of the operating members so that a person in a standing position may cut grass as close to the surface of the ground as desired.

Scott, U.S. Pat. No. 2,508,805 describes a fruit-picking device. This device has a pole and a hopper mounted on said pole and presents an opening for the reception of a fruit. In the operation of this device, the fruit picker as a whole is elevated with the front or open end of the hopper facing the operator. The hopper is moved to the fruit selected for picking in order to bring the stem of the fruit into the recess and the fruit itself within the confines of the hopper. The lever can then slide the cutter blade across the opening during which movement of the stem of the fruit is caught by the V-shaped cutting edge and severed.

Vosbikian, U.S. Pat. No. 3,156,980 describes shears for cutting and trimming. The purpose of this invention is to devise a novel and simplified construction of shears, which primarily is designed for grass cutting and trimming and can be used for cutting or trimming any desired material. Each handle is fixed to its respective cutting blade and passes through a bore laterally offset from the other handle through a top blade and is fixedly connected with a bottom blade.

Keyvani, U.S. Pat. No. 5,339,712 describes a tool of the type having two handles and a pivot axis, and two extension members longitudinal axially aligned with the pivot axis and each attached at one end to one of the handles and having at the other end working tool members positioned for opposed operation so that the handles operate in one plane and the working tool members operate in a parallel offset plane.

Keyvani, U.S. Pat. No. 5,339,712 describes a hand tool that includes a first handle that provides at one end a first hinge joint extending in a first direction and a hollow tube extending in the other direction. A fixed work element is attached at a distal end of the tube. A second handle is aligned with the first handle and provides a second hinge joint that extends in rotational engagement with the first hinge joint and includes a first set of gear teeth facing the tube. A hinge pin is pivotally engaged with and aligns the first and second hinge joints. As such, the second handle is rotatable toward and away from the first handle about the pin.

German patent, 704,090 describes hand pliers with an offset mandible.

The prior art teaches several hand tools having offset mandibles or jaws and other features related to the present invention. However, the prior art does not teach a linear finger actuated jaw operative tool satisfying the objectives of the present invention and having the structural elements and limitations of the instant teaching. The present invention fulfills these needs and provides further related advantages as described in the following summary.

SUMMARY OF THE INVENTION

The present invention teaches certain benefits in construction and use, which give rise to the objectives described below.

The present invention provides a slender, linear tool able to be rested in the crook of a hand between the thumb and first finger with a pair of actuation plates, which extend from the tool, in contact with the thumb and first finger respectively. The actuation plates are biased to assume a spaced apart relationship so that the fingers are able to move one of the plates toward the other. The movable plate is interconnected with a mandible or jaw through acentral rotatable rod while another mandible or jaw remains fixed. The actuation plates, therefore, are able to move the mandibles into a closed and, alternately, an open position. In one embodiment, the mandibles are shaped for grasping, while in another embodiment; the mandibles are shaped for cutting.

A primary objective of the present invention is to provide a mandible type hand tool, which can be used by the fingers only and is therefore independent of the palm of the hand, so that the palm is not needed in using the tool. The benefit is that the tactile sensitivity of the fingers and their fine control can be imparted to the tool.

Another objective is to provide such a tool where the fingers are pointed in the same direction as the mandibles so that the use of the tool follows the natural motion and direction of the fingers so that in using the tool there is no need to bend or rotate the wrist or arm which may cause muscular and tendon damage by repetitive motions thereof.

Another objective of the present invention is to provide such a tool that lies in the hand in a position similar to that of a pencil and is therefore used with comfort and a degree of familiarity.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 3:
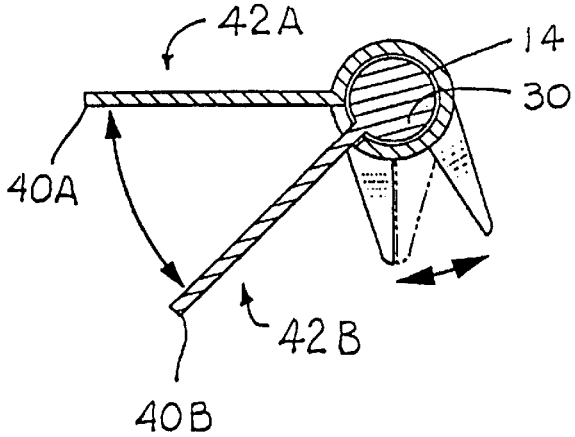
FIG. 3 is a section view thereof taken along line 3—3 in FIG. 2.
Figure 4:
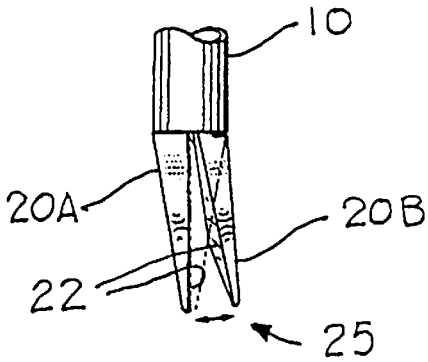
FIG. 4 is a partial front elevational view thereof taken in a direction indicated by line 5—5 in FIG. 2 and showing the pinch jaw adaptation of the tool.
Figure 5:
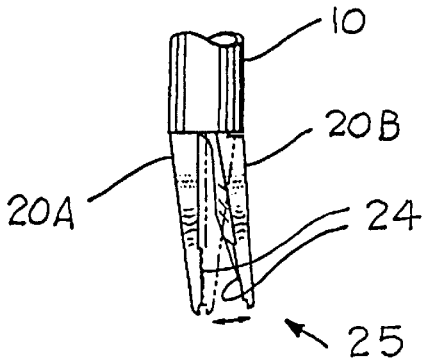
FIG. 5 is a partial front elevational view thereof taken in a direction indicated by line 5—5 in FIG. 2 and showing the cutting jaw adaptation of the tool.

The above described drawing figures illustrate the invention, a hand tool device having a linear, elongate, tool handle 10 of a size and shape for fitting comfortably between the thumb and first finger of one hand. The size and shape are preferably close to that of a common pencil, and the tool is held in a manner similar to that of a pencil. The tool handle 10 is formed integrally with a first tool jaw 20A, with the jaw extending at an angle from a proximal end 12 of the tool handle 10. The tool handle 10 encloses a hollow core 14 providing a first aperture 14A at the proximal end 12 of the tool handle 10, and a second aperture 14B positioned medially along a side wall 16 of the tool handle 10. A central core rod 30 (FIG. 3) is rotatably engaged within the hollow core portion 14 of the tool handle 10 and, a second tool jaw 20B is formed integrally with, and extends at, preferably the same angle as for jaw 20A, from the proximal end 12 of the tool handle 10 through the first aperture 14A so that it is positioned adjacent to the first jaw 20A but angularly spaced away from it. Rotation of the central core rod 30 brings the second tool jaw 20B into contact, or close proximity, with the first tool jaw 20A, and alternately into a position 25 that is angularly spaced apart from the first tool jaw 20A. The relative motion of jaws 20A and 20B are best illustrated in FIGS. 4 and 5 where the closed position of the jaw 20B is shown in phantom line, while the angularly spaced apart position of jaw 20B is shown in solid line. Therefore the jaws 20A, 20B are capable of being used, for instance, to grasp, crush or cut small objects.

A pair of spaced apart actuation plates, 40A and 40B, preferably extend radially outwardly from the tool handle 10 and are each shaped so as to provide a finger contact surface 42A and 42B respectively. A first of the actuation plates 40A is fixed to the sidewall 16 of the tool handle 10 in a position adjacent to the second aperture 14B. A second of the actuation plates 40B is fixed to the central core rod 30 and extends laterally outwardly from the second aperture 14B so that it is positioned at an acute angle with respect to the first of the actuation plates 14A when the jaws 20A, 20B are separated.

A bias means 50, preferably a coil spring, is positioned and fixed between the actuation plates 20A, 20B, so that with the tool handle 10 positioned between the thumb and the first finger, the actuation plates 20A, 20B are in positions to be manipulated by the thumb and first finger in order to rotate the central core rod 30 for positioning the second jaw 20B with respect to the first jaw 20A. In actuality it is just actuation plate 20B, which is moved to close or open the jaws, with plate 20A acting to as a reference or support element.

The jaws may be formed with grasping surfaces 22 (FIG. 4) for holding small parts, for instance, as with a needle-nosed pliers, or may be formed with cutting surfaces 24 (FIG. 5) for cutting wires as an example. The terminal portions of the jaws 26 are positioned at an angle with the tool handle 10, the angle preferably being 45 degrees, but may be any angle for advantageously adapting the device to a specific application. In order to provide motion between the jaws they must form an angle with respect to the tool handle.

Figure 1:
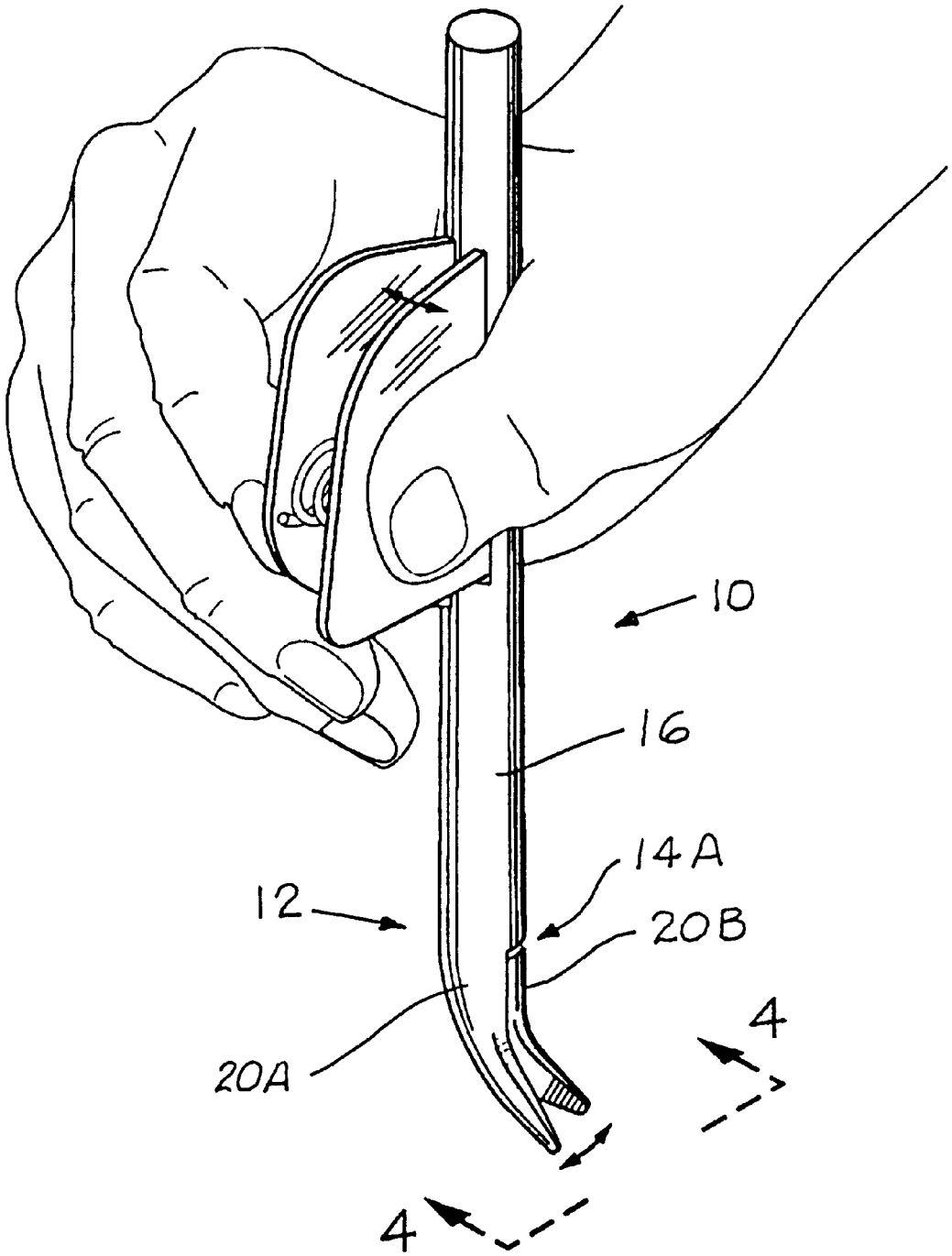
FIG. 1 is a perspective view of the preferred embodiment of the present invention with a pinch jaw adaptation, and showing how the invention is held and used in a hand.
Figure 2:
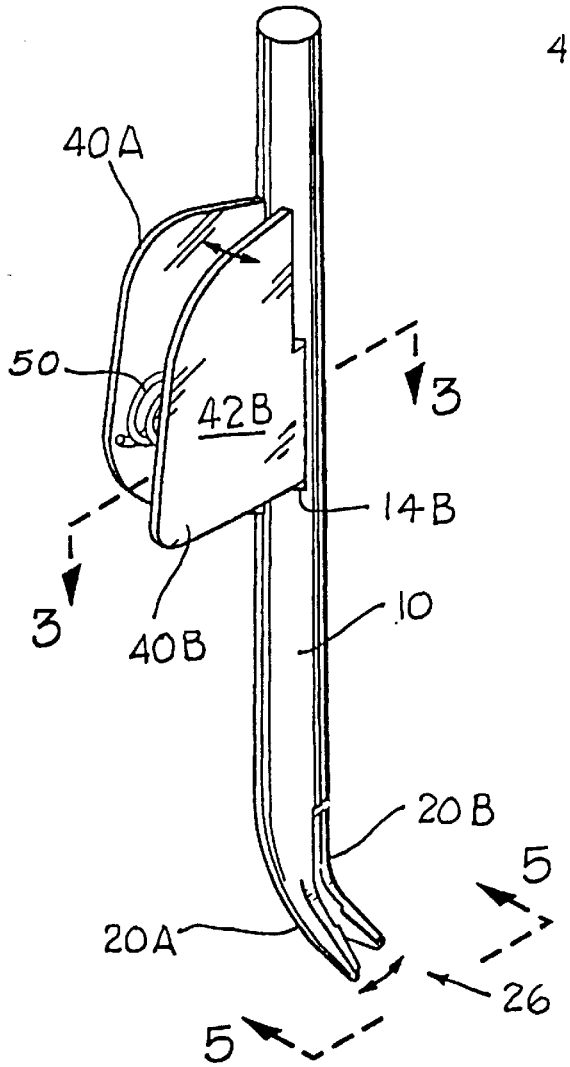
FIG. 2 is a perspective view thereof with a cutting jaw adaptation.

When the tool is held in its preferred orientation within the hand, the jaws 20A, 20B are preferably directed toward the person holding the device so as to allow the person to have maximum visibility of the jaws. This also places the jaws in the same direction as the several fingers holding the tool, see FIG. 1, so that the feel of the tool is completely natural and hand action is natural as well while manipulating the tool. It is considered to be a novel inventive aspect of the present invention to direct the jaws relative to the positions of the actuation plates as described and shown.

Figure 6:
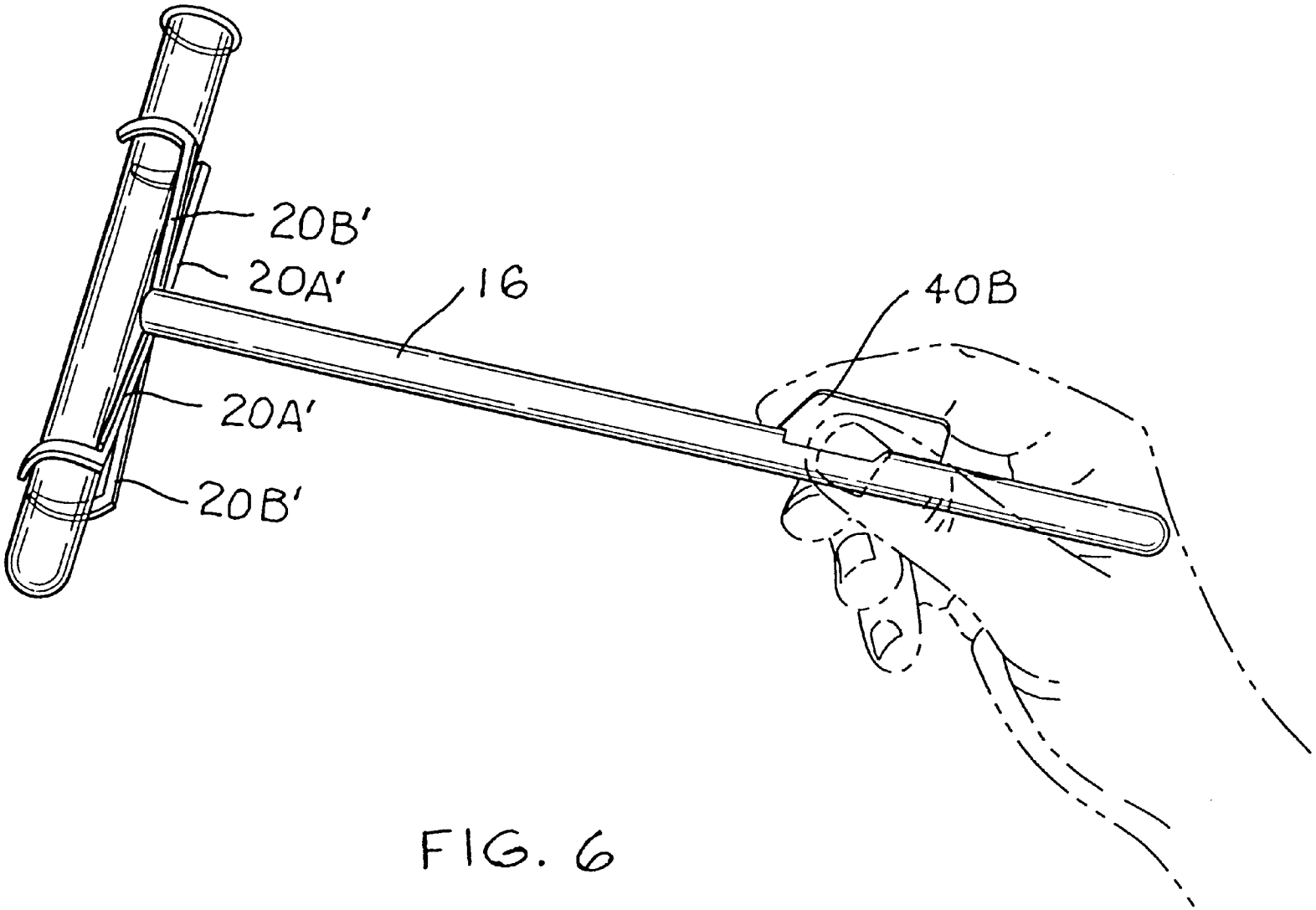
FIG. 6 is a perspective view of an alternate embodiment of the invention.

In an alternate embodiment shown in FIG. 6 the invention is adapted to provide an alternate set of tool jaws 20A' and 20B'. A first of the alternate tool jaws 20A' extends in two opposing directions at a right angle from the proximal end 12 of the tool handle 10 and is fixedly attached to the handle 10. A second of the alternate tool jaws 20B' is formed integrally with the central core rod 30 and extends at a right angle therefrom also two opposing directions, so that rotation of the central core rod 30 controls the angular relationship between the tool jaws 20A' and 20B'.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A hand tool device comprising:

a linear, elongate, tool handle of a size and shape for fitting comfortably between the thumb and first finger of a hand, and formed integrally therewith, a first tool jaw extending at an angle from a proximal end of the tool handle, the tool handle enclosing a hollow core providing a first aperture at the proximal end of the tool handle, and further providing a second aperture positioned medially along a side wall of the tool handle;

a central core rod rotatably engaged within the hollow core of the tool handle and, a second tool jaw formed integrally therewith and extending at said angle from the proximal end of the tool handle through the first aperture, so that rotation of the central core rod brings the second tool jaw alternately into contact with the first tool jaw, and angularly spaced apart therefrom;

a pair of spaced apart actuation plates, a first of the actuation plates being fixed to the side wall of the tool handle adjacent to the second aperture, a second of the actuation plates being fixed to the central core rod and extending laterally from the second aperture is positioned at an acute angle to the first of the actuation plates;

a bias means communicating with the actuation plates, so that with the tool handle positioned between the thumb and the first finger of the hand, the actuation plates are positioned for receiving finger pressure in order to rotate the central core rod for adjusting relative positions between the jaws.

2. The device of claim 1 wherein the actuation plates are aligned radially, extending outwardly from the tool handle at a medial position thereon.

3. The device of claim 1 wherein each of the jaws provides a grasping contact surface.

4. The device of claim 1 wherein each of the jaws provides a cutting surface.

5. The device of claim 1 wherein the bias means is a coil spring positioned between the two actuation plates.

6. The device of claim 1 wherein the angle formed between the jaws and the tool handle is approximately 45 degrees.

7. The device of claim 1 wherein with the tool held between the thumb and first finger of a hand and with the actuation plates in contact with the thumb and first finger respectively, the jaws are directed toward a person holding the device.

8. A hand tool device comprising:

a linear, elongate, tool handle of a size and shape for fitting comfortably between the thumb and first finger of a hand, and formed integrally therewith, a first tool jaw extending in two opposing directions at a right angle from a proximal end of the tool handle, the tool handle enclosing a hollow core providing a first aperture at the proximal end of the tool handle, and further providing a second aperture positioned medially along a side wall of the tool handle;

a central core rod rotatably engaged within the hollow core of the tool handle and extending through the first aperture;

a second tool jaw formed integrally with the central core rod and extending at a right angle therefrom in two opposing directions, so that rotation of the central core rod brings controls the angular relationship between the tool jaws;

a pair of spaced apart actuation plates, a first of the actuation plates being fixed to the side wall of the tool handle adjacent to the second aperture, a second of the actuation plates being fixed to the central core rod and extending laterally from the second aperture and forming an acute angle with the first of the actuation plates;

a bias means communicating with the actuation plates, so that with the tool handle positioned between the thumb and the first finger of the hand, the actuation plates are positioned for receiving finger pressure in order to rotate the central core rod for adjusting relative positions between the jaws.

9. The device of claim 8 wherein the actuation plates are aligned radially, extending outwardly from the tool handle at a medial position thereon.

10. The device of claim 8 wherein each of the jaws provides a grasping contact surface.

11. The device of claim 8 wherein the bias means is a coil spring positioned between the two actuation plates.

* * * * *